US008328700B2

(12) United States Patent
Humble et al.

(10) Patent No.: US 8,328,700 B2
(45) Date of Patent: Dec. 11, 2012

(54) RESISTANCE APPARATUS FOR EXERCISE DEVICES

(75) Inventors: David R. Humble, Fort Lauderdale, FL (US); Hans A. Barth, Fort Lauderdale, FL (US)

(73) Assignee: Product Labs, Inc., Deerfield Beach, FL (US)

( * ) Notice: Subject to any disclaimer, the term of this patent is extended or adjusted under 35 U.S.C. 154(b) by 61 days.

(21) Appl. No.: 13/007,871

(22) Filed: Jan. 17, 2011

(65) Prior Publication Data

US 2011/0111933 A1 May 12, 2011

Related U.S. Application Data

(62) Division of application No. 12/043,823, filed on Mar. 6, 2008, now Pat. No. 7,871,359.

(51) Int. Cl.
*A63B 21/02* (2006.01)
*A63B 21/045* (2006.01)
*B65H 75/48* (2006.01)

(52) U.S. Cl. ..... 482/127; 482/121; 242/375.1

(58) Field of Classification Search ..... 482/45, 482/46, 92, 99, 115, 118, 121, 72, 116, 908, 482/904, 136, 137, 138, 139, 127; 119/702, 119/796, 797, 798; 242/371, 372, 375.1, 242/375.2, 376; 54/46.1, 47, 71; 188/82.1, 188/82.6, 166; *A63B 21/02, 21/045; B65H 75/48*
See application file for complete search history.

(56) References Cited

U.S. PATENT DOCUMENTS

| | | | | |
|---|---|---|---|---|
| 4,202,510 | A * | 5/1980 | Stanish | 242/384.7 |
| 4,501,230 | A * | 2/1985 | Talo | 119/796 |
| 4,591,151 | A | 5/1986 | Hensley | |
| 4,805,901 | A | 2/1989 | Kulick | |
| 4,838,547 | A | 6/1989 | Sterling | |
| 4,933,657 | A | 6/1990 | Bessho et al. | |

(Continued)

FOREIGN PATENT DOCUMENTS

KR 10-2007-0045511 5/2007

OTHER PUBLICATIONS

DOMYOS: Fitness Cube, http://fitnesscube.domyos.com/EN, Nov. 2006.

(Continued)

*Primary Examiner* — Oren Ginsberg
(74) *Attorney, Agent, or Firm* — Fleit Gibbons Gutman Bongini & Bianco PL; Thomas Grzesik; Jon A. Gibbons

(57) ABSTRACT

A resistance apparatus for use with exercise devices includes an axle and outer housing for rotatably mounting the axle therein. At least one inner housing includes an opening for receiving the axle therethrough so that the inner housing is fixably mounted on the axle. The inner housing is rotatably mounted inside the outer housing to permit rotation of the inner housing along with the axle within the outer housing. At least a first tensioned member is disposed within the inner housing. The first tensioned member includes a first end and a second end. The first end of the tensioned member engages an engagement area of the inner housing. The second end of the tensioned member engages an engagement area of the outer housing. The tensioned member creates a rotational restoring force between the inner housing and the outer housing.

18 Claims, 6 Drawing Sheets

U.S. PATENT DOCUMENTS

| | | | | |
|---|---|---|---|---|
| 5,176,601 | A | 1/1993 | Reynolds | |
| 5,269,512 | A | 12/1993 | Crowson et al. | |
| 5,360,382 | A | 11/1994 | Chi | |
| 5,505,681 | A | 4/1996 | Bruggemann | |
| 5,669,865 | A | 9/1997 | Gordon | |
| 5,718,659 | A | 2/1998 | Van Straaten | |
| 5,733,231 | A * | 3/1998 | Corn et al. | 482/120 |
| 5,899,836 | A | 5/1999 | Chen | |
| 5,906,566 | A | 5/1999 | Whitcomb | |
| 5,944,641 | A | 8/1999 | Habing | |
| 5,997,442 | A | 12/1999 | Cordes | |
| 6,152,866 | A | 11/2000 | Kuo | |
| 6,264,586 | B1 | 7/2001 | Webber | |
| 6,761,670 | B2 * | 7/2004 | Liou | 482/72 |
| 6,929,589 | B1 | 8/2005 | Bruggemann et al. | |
| 7,128,700 | B2 | 10/2006 | Wallach | |
| 7,137,936 | B1 * | 11/2006 | Shaw et al. | 482/127 |
| 7,195,584 | B1 | 3/2007 | Lu et al. | |
| 7,226,401 | B2 | 6/2007 | Van Stratten et al. | |
| 7,261,676 | B2 * | 8/2007 | Liou | 482/72 |
| 7,294,096 | B1 | 11/2007 | Stearns | |
| 7,871,359 | B2 * | 1/2011 | Humble et al. | 482/127 |
| 2002/0025891 | A1 | 2/2002 | Colosky, Jr. et al. | |
| 2003/0050153 | A1 | 3/2003 | Stevens | |
| 2004/0180761 | A1 * | 9/2004 | Liou | 482/72 |
| 2005/0101447 | A9 * | 5/2005 | Pyles et al. | 482/54 |
| 2008/0280734 | A1 | 11/2008 | Dickie et al. | |

OTHER PUBLICATIONS

International Search Report dated Jul. 28, 2008 for PCT/US2008/063873.

* cited by examiner

RESISTANCE APPARATUS FOR EXERCISE DEVICES

CROSS-REFERENCE TO RELATED APPLICATIONS

The present patent application is a divisional of U.S. patent application Ser. No. 12/043,823, entitled "RESISTANCE APPARATUS FOR EXERCISE DEVICES", now U.S. Pat. No. 7,871,359, filed on Mar. 6, 2008 and is related to commonly owned U.S. patent application Ser. No. 11/750,093, entitled "Foldable Exercise Device", now U.S. Pat. No. 7,806,812, filed on May 17, 2007, the entire teachings of which are being hereby incorporated by reference in their entirety.

FIELD OF THE INVENTION

The present invention generally relates to the field of exercise equipment, and more particularly relates to an apparatus for providing resistance while using an exercise device.

BACKGROUND OF THE INVENTION

Personal health and fitness has become increasingly popular over the recent years. As a result, health club memberships and personal fitness equipment sales have increased. Personal fitness equipment is especially popular because it allows individuals to exercise on their own time while in the convenience and privacy of their own homes. Exercise equipment generally uses weights as the primary source of resistance. However, other sources of resistance such as flexible bands or hydraulics can also be used. Flexible bands are often found on exercise equipment so that a user is not required to maintain and store bulky weights.

Items such as springs are generally not used as a source of resistance for exercise equipment. This is because many spring motors have a very short life expectancy and are not suitable for repetitive use. Additionally, spring motors generally do not exert any resistance at their resting position. Therefore most spring motors would not provide an experience similar to that of using free-weights or stacked weights.

SUMMARY OF THE INVENTION

According to one embodiment of the present invention, a resistance apparatus for use with exercise devices is disclosed. The resistance apparatus includes an axle an outer housing for rotatably mounting the axle therein. At least one inner housing includes an opening for receiving the axle therethrough so that the inner housing is fixably mounted on the axle. The inner housing is rotatably mounted inside the outer housing to permit rotation of the inner housing along with the axle within the outer housing. At least a first tensioned member is disposed within the inner housing. The first tensioned member includes a first end and a second end. The first end of the tensioned member engages an engagement area of the inner housing. The second end of the tensioned member engages an engagement area of the outer housing. The tensioned member creates a rotational restoring force between the inner housing and the outer housing.

In another embodiment a resistance apparatus for use with exercise devices is disclosed. The resistance apparatus includes a first resistance cartridge and at least a second resistance cartridge. The resistance apparatus also includes an axle. The first resistance cartridge and the at least second resistance cartridge are co-axially aligned with respect to each other and are fixably mounted to the axle. The axle includes a groove along the axial direction that receives an engagement member slidably mounted within the groove. The engagement member selectably engages at least one of the first resistance cartridge and the at least second resistance cartridge.

In yet another embodiment an inner housing for use within a resistance apparatus is disclosed. The inner housing comprises an outer portion that is substantially circular. An inner portion includes an opening for receiving an axle therethrough so that the inner portion is fixably mounted on the axle. At least a first tensioned member is disposed within the inner portion. The first tensioned member includes a first end and a second end. The first end of the tensioned member engages an engagement area on an inner area of the outer portion. The second end of the tensioned member is adapted to engage an engagement area of an outer housing that maintains the inner housing. The tensioned member creates a rotational restoring force between the inner housing and the outer housing.

BRIEF DESCRIPTION OF THE DRAWINGS

The accompanying figures where like reference numerals refer to identical or functionally similar elements throughout the separate views, and which together with the detailed description below are incorporated in and form part of the specification, serve to further illustrate various embodiments and to explain various principles and advantages all in accordance with the present invention.

DETAILED DESCRIPTION

As required, detailed embodiments of the present invention are disclosed herein; however, it is to be understood that the disclosed embodiments are merely exemplary of the invention, which can be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure. Further, the terms and phrases used herein are not intended to be limiting; but rather, to provide an understandable description of the invention.

The terms "a" or "an", as used herein, are defined as one or more than one. The term plurality, as used herein, is defined as two or more than two. The term another, as used herein, is defined as at least a second or more. The terms including and/or having, as used herein, are defined as comprising (i.e., open language). The term coupled, as used herein, is defined as connected, although not necessarily directly, and not necessarily mechanically.

The materials used to construct the present invention are metal, however, other materials including plastics, metal alloys, composites, ceramics, and other inorganic or organic materials or combinations thereof may be used.

Although the invention is described in terms of an exemplary embodiment, it will be readily apparent to those skilled in this art that various modifications, rearrangements, and substitutions can be made without departing from the spirit of the invention. The scope of the invention is defined by the claims appended hereto.

An advantage of the various embodiments of the present invention is that resistance apparatus comprising tensioned members is presented. The tensioned members do not fatigue very quickly, thereby giving the user a reasonable lifespan. Another advantage is that the tensioned members such as wound springs are torqued. This allows the user to experience instant resistance. State differently, the tensioned members provide resistance from a resting point all the way to and end point of rotation. The resistance apparatus can be configured so that additional tensioned members can be and selected, thereby providing a variable degree of resistance to the user.

Exercise Resistance Apparatus

Figure 1:
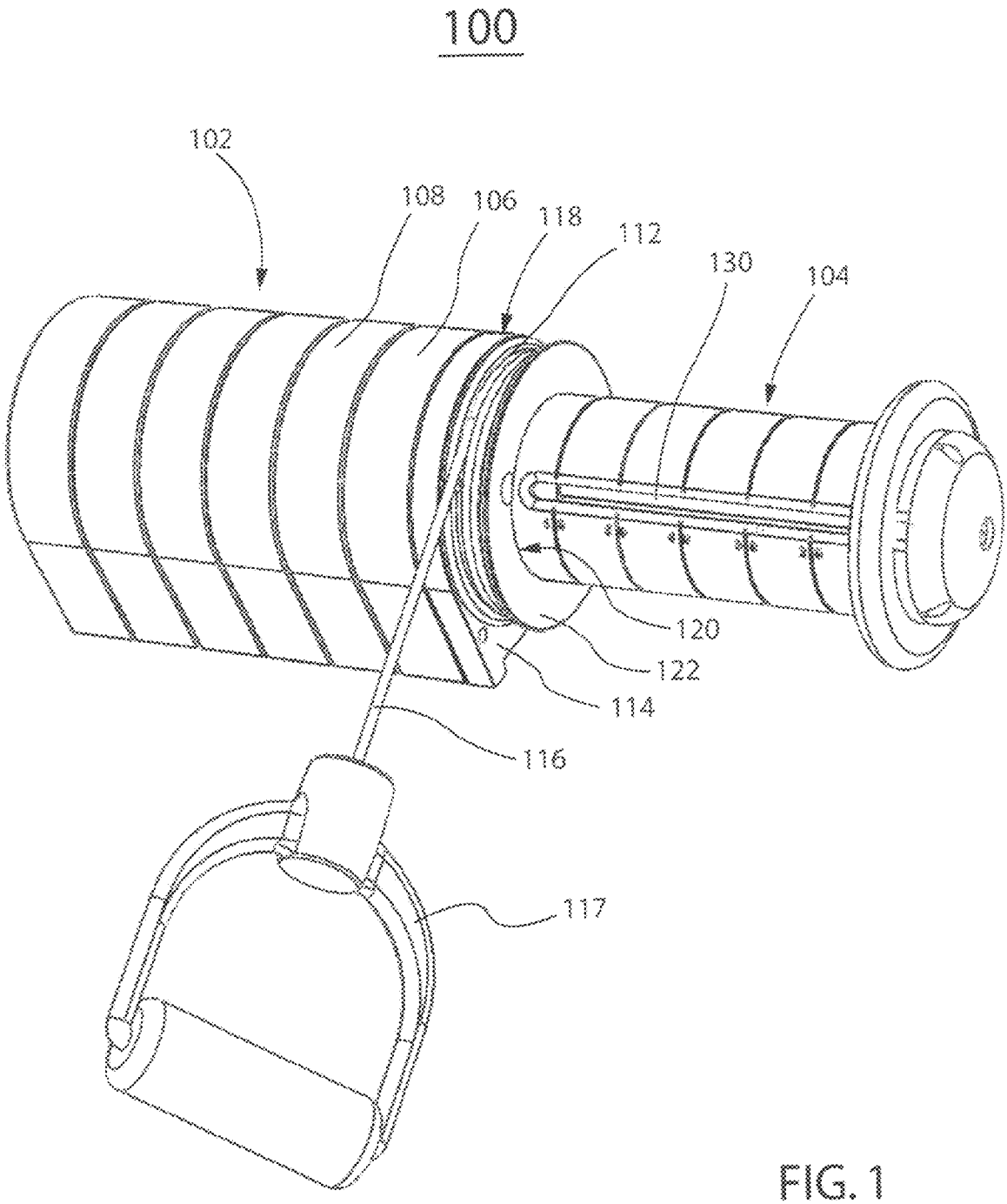
FIG. 1 is a front view of a resistance apparatus according to one embodiment of the present invention.

According to one embodiment of the present invention, as shown in FIG. 1, an exercise resistance apparatus 100 is illustrated. The resistance apparatus 100 provides resistance to a user during an exercise in both the positive and negative directions. For example, the resistance apparatus 100 can provide resistance to a user while the user is interacting with an exercise machine such as that discussed in U.S. patent application Ser. No. 11/750,093, entitled "Foldable Exercise Device", now [pending], the entire teaching of which is hereby incorporated by reference in its entirety. The resistance apparatus 100, in one embodiment, includes a first outer portion 102 and a second outer portion 104 that extends outwards in a lateral direction from the first outer portion 102. The first outer portion 102 can be a single unit or be comprised of multiple resistance cartridges 106, 108. In one embodiment where the first outer portion 102 includes multiple resistance cartridges 106, 108, each of the resistance cartridges 106, 108 are mechanically coupled to at least one other resistance cartridge, thereby making the first outer portion 102 a single unit. It should be noted that the first and second outer portions 102, 104 can be comprised of materials such as (but not limited to) metals, metal-alloys, plastics, and composites.

Each of the resistance cartridges 106, 108 include a tensioned member 310 (FIG. 3), discussed in greater detail below, that provides a given degree of resistance. For example, each resistance cartridge 106, 108 can provide 10 lbs of resistance or any other degree of resistance. Also, the resistance cartridges 106, 108 are not limited to providing the same degree of resistance. At least one pulley mechanism 112 is disposed at one end 114 of the first outer portion 102 of the resistance apparatus 100. The pulley mechanism 112 is configured to maintain a connector 116 such as (but not limited to) rope, wire, cable, cord, or chain that when pulled rotates the pulley mechanism 112. The connector 116 can be coupled to a grip 117 that allows the user to pull the connector 116. In one embodiment, the pulley mechanism 112 is mechanically coupled to an end plate 118 of the first outer portion 102 or an end resistance cartridge 106.

Figure 2:
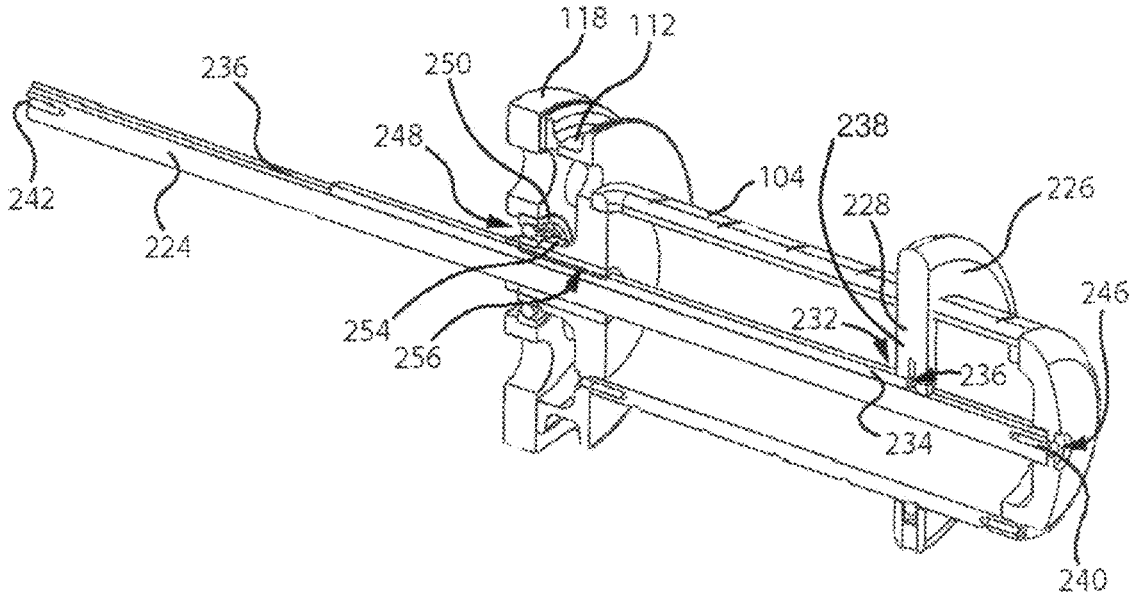
FIG. 2 is a side angled cross-sectional view of a portion of the resistance apparatus of FIG. 1 according to one embodiment of the present invention.

In one embodiment, one end 120 of the second outer portion 104 is mechanically coupled to an outer facing portion 122 of the pulley mechanism 112. Therefore, when the pulley mechanism 112 rotates so does the second outer portion 104. The second outer portion 104, in one embodiment, houses an axle/shaft 224, as shown in FIG. 2, which selectively engages each tensioned member 310 and also engages or is engaged by the pulley mechanism 112. Therefore, when the pulley mechanism 112 rotates, the engaged axle 224 also rotates. As the axle 224 rotates, any tensioned member 310 engaged by the axle 224 also rotates, thereby providing resistance.

The axle 224, in one embodiment, can selectively engage a tensioned member 310 by adjusting the position of a sliding member 226. For example, the sliding member 226 includes an extending portion 228 that extends into the second outer portion 104 through a slot 130 and is coupled to or engages a portion 232 of the axle 224. In one embodiment, the portion 232 of the axle 224 is an engagement member 234 disposed in a groove 236 (e.g., keyway) on the axle 224. In one embodiment, the groove 236 is disposed on the axle 224 in the axial direction.

A lower area 238 of the extending portion 228 is either mechanically coupled to or engages the engagement member 234. As the sliding member 226 moves in a lateral direction on the second outer portion 104, the engagement member 234 also moves in a lateral direction within the groove 236 formed along the axle 224. In this embodiment, as the engagement member 234 is positioned into the first outer portion 102, the engagement member 234 sequentially engages each tensioned member 310 within the resistance cartridges 106. The term "engages" means that the tensioned member is mechanically coupled to the axle 224 so as to rotate. In this embodiment, the axle 224 remains stationary in the lateral direction. For example, a first end 240 and a second end 242 of the axle 224 are coupled to one end 344 (FIG. 3) of the first outer portion 102 and one end 246 of the second outer portion 104, respectively.

However, it should be noted that the axle 224 can be configured to slide in and out of the first outer portion 102 for selectively engaging a tensioned member 310. In this embodiment a separate engagement member 234 is not required since the axle 224 can include various portions (not shown) that engage a tensioned member 310 when the axle 224 is slid into the first outer portion 102. It should also be noted that in another embodiment, the axle 224 remains within the first outer portion 102 and only the engagement member 234 extends into the second outer portion 104. Also, in another embodiment, the second outer portion 104 is not required. For example, the axle 224 can be configured to include various areas (not shown) that selectively engage the tensioned members 310 of the resistance cartridges 106, 108, to be mechanically coupled to turn with the axle 224.

In this embodiment, the axle 224 remains within the first outer portion 102 and is coupled to an end portion (not shown). This end portion can be rotated, thereby rotating the axle 224. As the axle 224 rotates the various areas (not shown) can sequentially or selectively engage one or more of the tensioned members 310 to provide varying degrees of resistance to the user. It should be noted that other components can be used such as cams and/or solenoids for selectively engaging one or more tensioned members 310.

FIG. 2 also shows, in one embodiment, that the end plate 118 of the first outer portion 102 includes an inner area 248. This inner area 248, in one embodiment, includes a bearing 250. The bearing 250 can be a ball bearing, a cylindrical roller, or any other type of bearing. The pulley mechanism 112 also includes an inner area (not shown) that comprises an extending member 254. This extending member 254 is configured to be received at least partially within the bearing 250 so that the pulley mechanism 112 rotates smoothly. The extending member 254 of the pulley mechanism 110 is hollow and includes a groove 256. This groove 256 maintains a portion 232 of the axle 224 such as the engagement member 234 that pushes against the groove 256 when the groove 256 of the pulley mechanism 112 is rotated. As the groove 256 pushes against the portion 232 of the axle 224, the axle 224 rotates, thereby mechanically coupling the tensioned member 310 to the axis so as to turn together as a unit. This provides resistance to the user as the connector 116 is pulled from the pulley mechanism 112.

Figure 3:
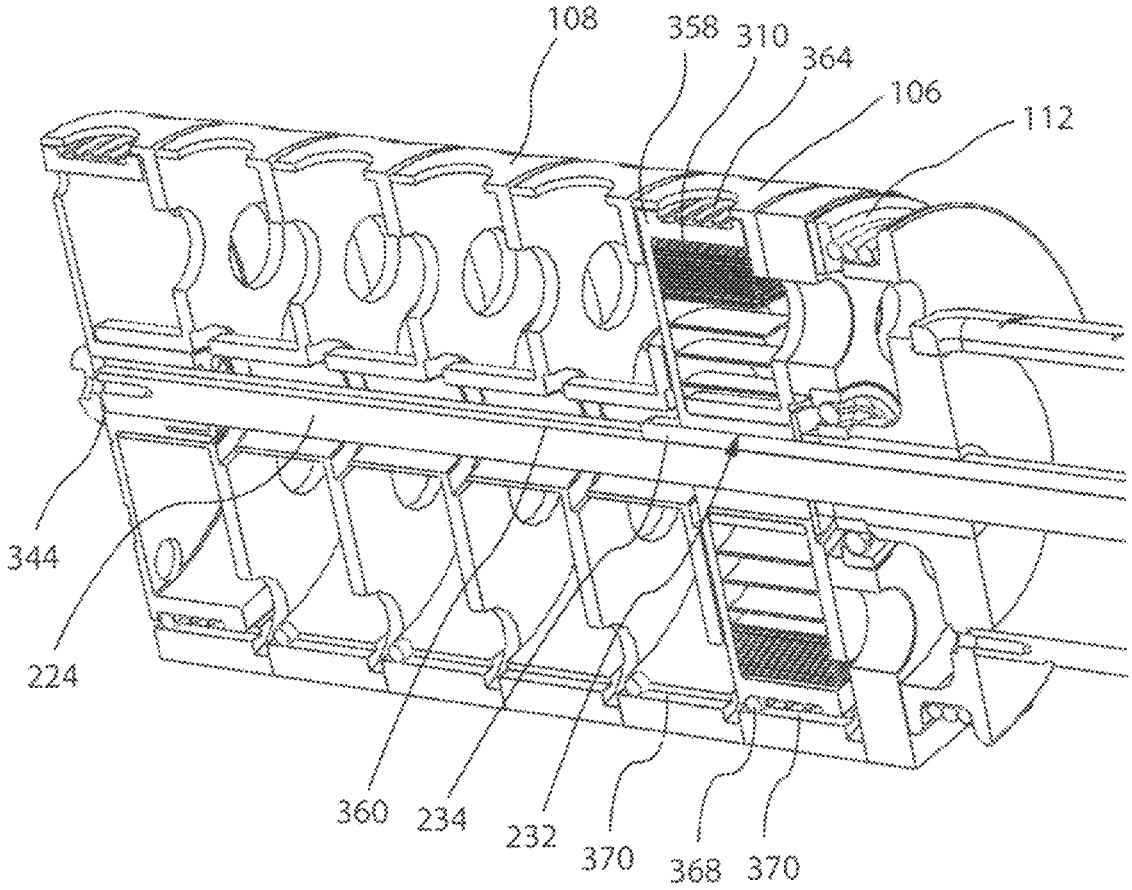
FIG. 3 is a side angled cross-sectional view of another portion of the resistance apparatus of FIG. 1 according to one embodiment of the present invention.

FIG. 3 shows a top-angled cross-sectional view of the first outer portion 102. In particular, FIG. 3 shows a tensioned member 310 residing within a resistance cartridge 106. FIG. 3 also shows a plurality of other resistance cartridges 108. These resistance cartridges 108 have been shown without tensioned members 310 for simplified illustration purposes only. For example, the first outer portion 102 can include empty resistance cartridges 108 so that a user can add tensioned members in the future. In one embodiment, the tensioned member 310 is disposed within a housing 358 herein referred to as a "torque setter 358".

FIG. 3 further shows the axle 224 having engaged the tensioned member 310. For example, a portion 232 of the axle 224 such as the engagement member 234 has engaged a groove 360 (also shown in FIG. 4) within a hollow area 462 of the torque setter 358. The torque setter 358 also includes helical grooves 364 circumscribing an outer portion 466 (FIG. 4) of the torque setter 358. In one embodiment, a rolling member such as roller pin 368 is disposed within a lateral groove 370 of the resistance cartridge 106. As the torque setter 358 is disposed within the resistance cartridge 106, a helical groove 364 on the outer portion 366 of the torque setter 358 rests on the roller pin 368. The tensioned member 310, torque setter 358, and rolling member 368 are discussed in greater detail below.

Figure 4:
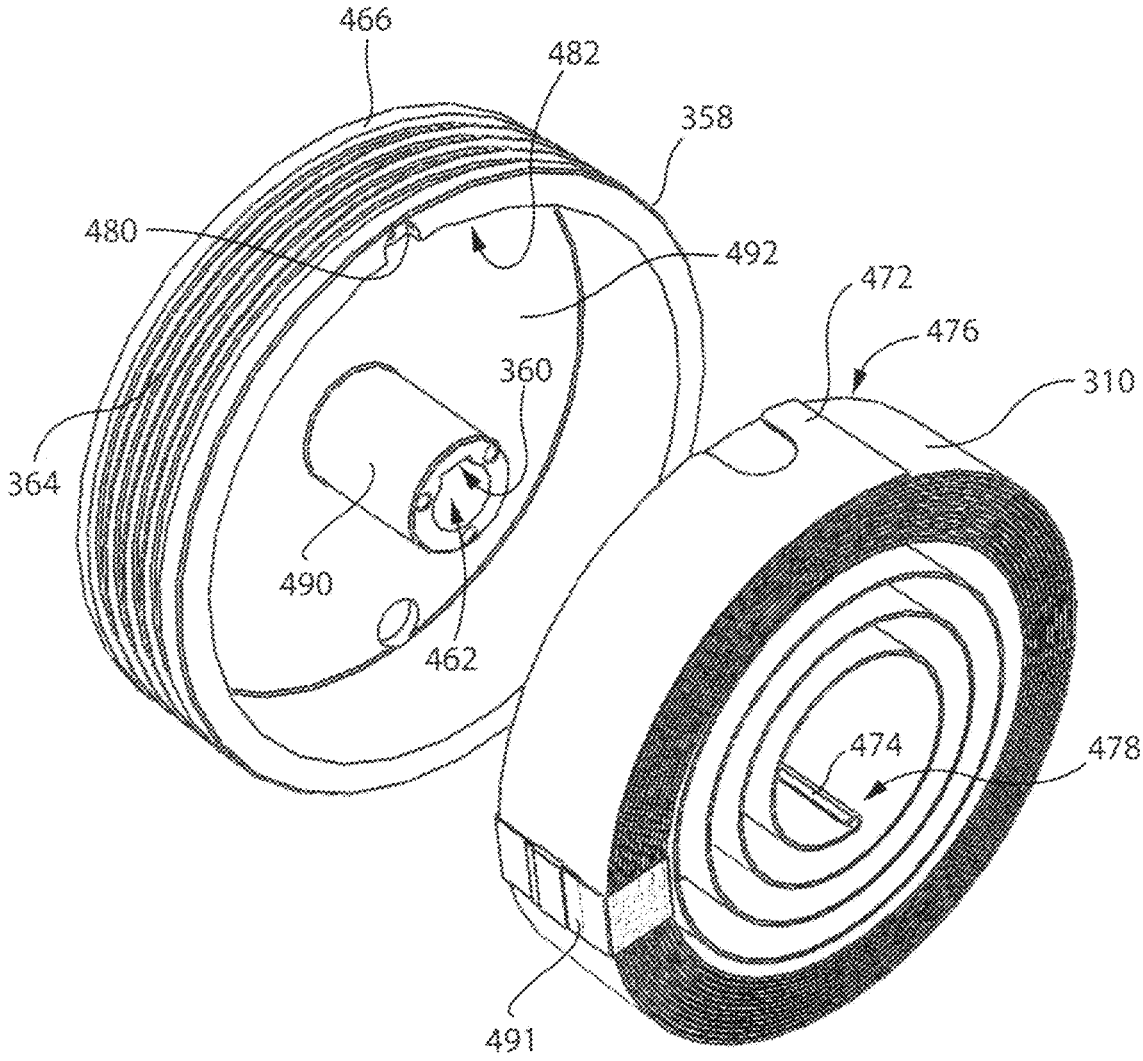
FIG. 4 is a side exploded view of a housing that maintains a tensioned member according to one embodiment of the present invention.

FIG. 4 shows a top-angled exploded view of the torque setter 358 and tensioned member 310. In one embodiment, the tensioned member 310 is a spring such as a clock spring. The types of spring, material, width, length, defines the spring constant k in Hook's law $F=-kx$, where x is the distance that the spring has been stretched or compressed away from the equilibrium position. The equilibrium position is generally the position where the spring would naturally come to rest. F is the restoring force exerted by the material. The resistance apparatus 100 can use any configuration of a wound spring to provide a given resistance. For example, a spring wound a specific number of times can be selected to provide a desired initial resistance such as 5 lbs, 10 lbs, 15 lbs, and the like. The tensioned member 310 includes a first end 472 and a second end 474. In one embodiment using a wound spring as the tensioned member 310 one of the ends 472 is on the outside 476 of the tensioned member 410 and the other end 474 is within an inner area 478 of the tensioned member 310.

Figure 5:
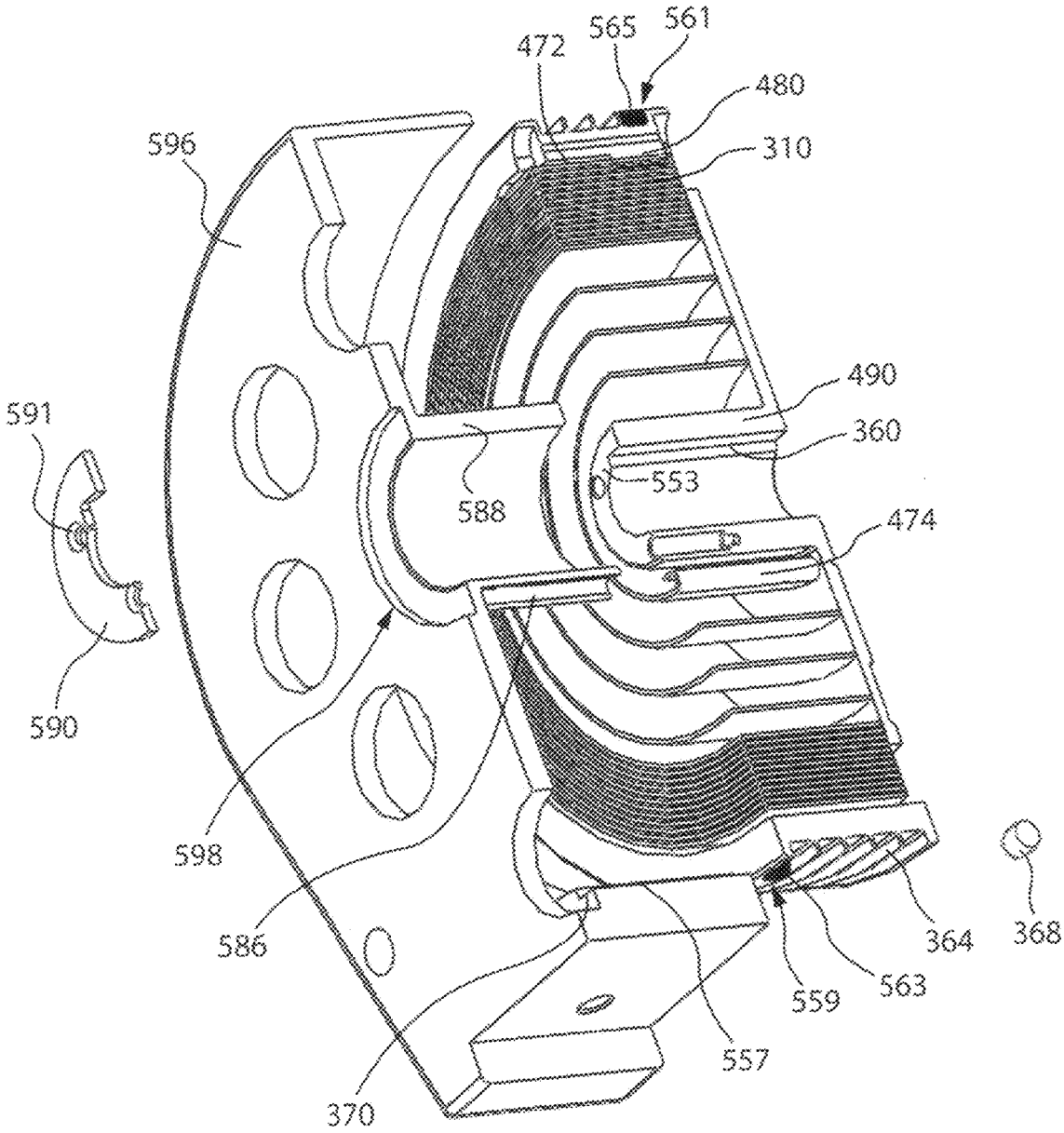
FIG. 5 is a bottom angled exploded view a housing that maintains the housing and tensioned member of FIG. 4 according to one embodiment of the present invention.

In one embodiment, the outside end 472 has an open/hook type configuration that engages an attachment area 480 on an inside wall 482 of the torque setter 358, as shown in FIG. 4 and FIG. 5. The inner end 474, in one embodiment, has a bent/curled configuration that engages the recessed area/groove 586 disposed on an extending member 588 of the resistance cartridge 106, as shown in FIG. 5. It should be noted that these end configurations are only for illustrative purposes and do not limit the present invention to such configurations. The tensioned member 310 is placed within the torque setter 358 by inserting an extending member 490 of the torque setter 358 disposed on an end wall 492 into the inner area 478 of the tensioned member 310. FIG. 4 also shows the helical grooves 364 on the outside portion 466 of the tensioned member 310. FIG. 4 shows the tensioned member 310 comprising a band 491. In one embodiment, this is how the tensioned member 310 comes from the manufacturer. The band 491 is removed once the tensioned member 310 is placed within the torque setter 358.

FIG. 5 is cross-sectional exploded of view of the resistance cartridge 108 comprising the torque setter 358. FIG. 5 shows the tensioned member 310 disposed within the torque setter 358. Once the tensioned member 310 is within the torque setter 358, the torque setter 358 can be inserted into the resistance cartridge 106. FIG. 5 shows a first portion 596 of the resistance cartridge 106. In one embodiment, the first portion 596 of the resistance cartridge 106 includes an inner area 598 comprising an extending member 588. The extending member 588 is hollow and has a diameter that is slightly larger than the diameter of the extending member 490 of the torque setter 358.

The extending member 588 of the resistance cartridge 106 receives the extending member 490 of the torque setter 358. The extending member 588 also includes a recessed 586 area or a groove that engages the inner end 474 of the tensioned member 310. FIG. 5 also shows the outer end 472 of the tensioned member 310 engaging the attachment area 480 of the torque setter 358. Once the extending member 490 of the torque setter 358 is inserted into the extending member 588 of the resistance cartridge 106, a captivating member 590 such as a washer is placed on an outside edge 551 of the resistance cartridge extending member 588. Fasteners such as screws, bolts, rivets, and the like can be inserted into fastening areas 593 disposed on the captivating member 590 to couple the captivating member 590 to an outside edge 553 of the torque setter extending member 490, thereby maintaining the torque setter 358 and tensioned member 310 within the resistance cartridge 106.

After the torque setter 358 has been coupled to the resistance cartridge 106, the tensioned member 310 can be tuned to a given degree of resistance. For example, the torque setter 358 can be rotated a number of times to further wind and place tension on the tensioned member 310. The tensioned member 310 experiences tension as the torque setter 358 is wound because the outer end 472 of the tensioned member 310 is engaged by the attachment area 480 of the torque setter 358 and the inner end 474 is engaging the recessed area 586 of the resistance cartridge 106, which remains stationary as the torque setter 358 rotates. Therefore, as the torque setter 358 is wound the tensioned member 310 becomes tighter according to Hook's Law.

Figure 6:
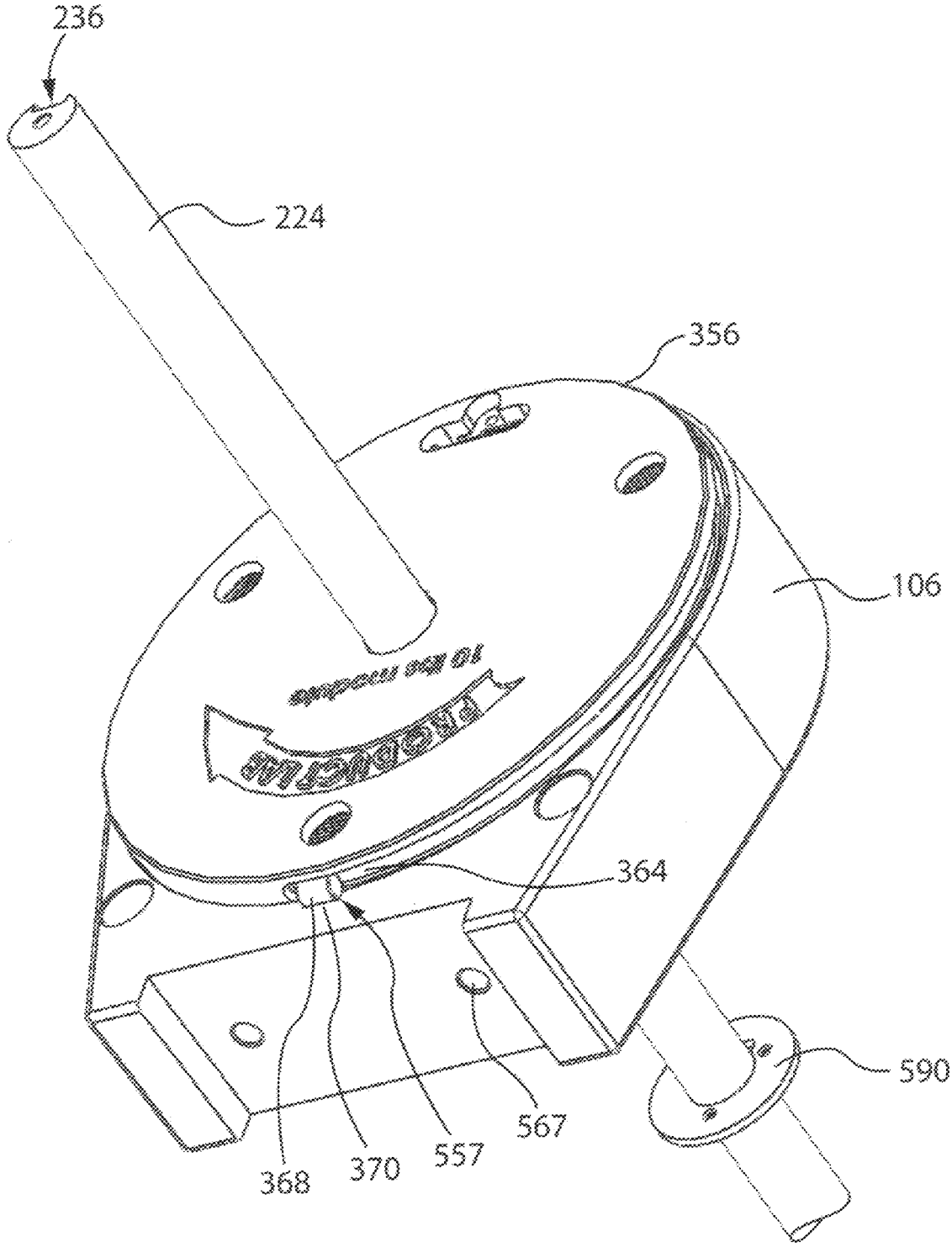
FIG. 6 is a bottom angled view of the housing of FIG. 5 comprising the housing and tensioned member of FIG. 4 according to one embodiment of the present invention.

Once the torque setter 358 has been wound a desired number of times, the rolling member 368 is placed within the lateral groove 370 of the resistance cartridge 106. The lateral groove 370 is disposed on a lower portion 557 (or upper portion depending how the cartridge 106 is oriented) of the cartridge 106 as shown in FIG. 6. As discussed above, as the helical groove 364 of the torque setter 358 rests on the roller pin 368. Therefore, the rolling member 368 becomes captive within the lateral groove 370 and follows the helical groove 364 pitch position in the lateral groove 370. In one embodiment, the lateral groove 370, has a width that substantially corresponds to the width of the helical grooves 364 on the outside portion 366 of the torque setter 358.

The helical grooves 364 in combination with the lateral groove 370 and the rolling member 368 defines a limit of rotation of the torque setter 358 housing within the resistance cartridge 106 and hence, the range of the tensioned member operates within a force versus displacement curve. In one embodiment, to keep the force/resistance constant the range is limited to a substantially linear range of the curve. For example, FIGS. 3, 4, 5, and 6 show 4 helical grooves 364, which allow the toque setter 358 to be rotated 4 times or 4 revolutions. As a user pulls the connector 116 from the pulley mechanism 112, the pulley mechanism 112 rotates the axle 224, thereby rotating the torque setter 358. As the torque setter 358 is performing a revolution, the helical grove 364 moves over the rolling member 368 causing the rolling member 368 to travel in a lateral direction within the lateral groove 370. Because the torque setter 358 only includes 4 helical grooves 364 in this example, the torque setter 358 only performs 4 revolutions. The rolling member 368 allows the torque setter 358 to rotate smoothly and also helps maintain the torque setter 358 within the resistance cartridge 106 by moving back and forth within the lateral groove 370.

Additionally, because the torque setter 358 and tensioned member 310 have been wound a given number of times, the torque setter/tensioned member unit has a given torque range. For example, if the tensioned member 310 has a limit of 20 winds, the torque setter 358 can be wound 20 times and then the rolling member 368 inserted into the lateral groove 370. In the above example, the 4 helical grooves 364 roll over the rolling member 368 four times, thereby placing the torque setter 358 and tensioned member 310 at 16 winds when the torque setter 358 is at a resting position. In this example, the torque range of the torque setter 358 and tensioned member 310 is 16/20 winds. In other words, the torque setter 358 begins at 16 winds and has a final position at 20 winds. Therefore, the tensioned member 310 is torqued even when resting so that a user experiences instant resistance similar to free-weights.

Continuing with the above example, torque setter 358 is configured so that 4 revolutions allow the connector 116 to be pulled out about 4 feet from the pulley mechanism 112. If less length or more length is desired, the torque setter 358 can be made larger so that one revolution travels more distance. The torque setter 358 can also be made wider to accommodate additional helical grooves, which also allows for more revolutions. In one embodiment, each end 559, 561 of the helical groove 364 includes a stopping mechanism 563, 565 such as (but not limited to) a metal pin. These stopping mechanisms 563, 565 prevent damage to the resistance apparatus 100. For example, if a user accidently lets go of the connector 116, the tensioned mechanism 310 return to its resting position very quickly. A stopping mechanism 563 at the first end 559 of the helical groove 364 provides a reinforced stopping area that catches the rolling member 368 to stop the torque setter 358 from rotating beyond its resting position. The stopping mechanism 565 at the second end 561 prevents the torque setter 358 from traveling beyond the final rotation of the torque setter 358.

FIG. 6 shows a bottom angled view of the resistance cartridge 106 comprising the torque setter 358 and the tensioned member 310. In particular, FIG. 6 shows the other side of the resistance cartridge 106 than what is shown in FIG. 5. FIG. 6 also shows the axle 224 passing through the resistance cartridge 106 and the torque setter 358. As can be seen from FIG. 6, the rolling member 368 is disposed within the lateral groove 370 of the resistance cartridge 106 and within the helical groove 364 of the torque setter 358. As the axle 224 rotates the torque setter 358 the helical groove 364 causes the rolling member 368 to travel back and forth within the lateral groove 370. FIG. 6 also shows the captivating member 590 that couples to the outside edge 553 of the torque setter extending member 490 and outside edge 551 of the resistance cartridge 106. The resistance cartridge 106 also includes various fastening areas 567 for coupling the resistance apparatus 100 to an exercise device, a floor, a wall, or any other object. It should be noted that the fastening areas 567 can be disposed at any location on the resistance cartridge 106.

NON-LIMITING EXAMPLES

Although specific embodiments of the invention have been disclosed, those having ordinary skill in the art will understand that changes can be made to the specific embodiments without departing from the spirit and scope of the invention. The scope of the invention is not to be restricted, therefore, to the specific embodiments, and it is intended that the appended claims cover any and all such applications, modifications, and embodiments within the scope of the present invention.

What is claimed is:

1. A resistance apparatus for use with exercise devices, the resistance apparatus comprising;

an axle;

an outer housing for rotatably mounting the axle therein;

at least one inner housing, with an opening configured to receive the axle therethrough, wherein at least a portion of the opening is configured for selective engagement by a slidable engagement member of the axle, whereby the selective engagement rotatably mounts the inner housing inside the outer housing permitting rotation of the inner housing along with the axle within the outer housing; and at least a first tensioned member disposed within the inner housing, wherein the first tensioned member includes a first end and a second end, and the first end of the tensioned member engages an engagement area of the inner housing and the second end of the tensioned member engages an engagement area of the outer housing, and wherein the tensioned member creates a rotational restoring force between the inner housing and the outer housing.

2. The resistance apparatus of claim 1, wherein the axle includes a groove along an axial direction that receives the slidable engagement member, wherein the slidable engagement member is slidably mounted within the groove, wherein the slidable engagement member includes a first portion and a second portion, wherein the first portion of the slidable engagement member is configured to mate with a selecting area of the inner housing so as to mechanically couple the axle to the inner housing, wherein the second portion of the slidable engagement member extends beyond the outer housing.

3. The resistance apparatus of claim 1, wherein an outer portion of the inner housing comprises a given number of helical grooves circumscribing the outer portion.

4. The resistance apparatus of claim 3, wherein the outer housing includes a groove that is disposed within the outer housing parallel to the axle, wherein a void is formed between the helical grooves and the groove disposed on the outer housing to accommodate a cylindrical roller therebetween, and whereby the given number of helical grooves in combination with the groove and the cylindrical roller defines a number of rotations of the inner housing within the outer housing.

5. The resistance apparatus of claim 4, whereby the given number of helical grooves in combination with the groove and the cylindrical roller pretensions the tensioned member, wherein the pretensioned tensioned member exerts a restorative force when at a resting position.

6. The resistance apparatus of claim 1, wherein the tensioned member is a clock spring with the first end coupled to the engagement area of the inner housing and the second end coupled to the engagement area of the outer housing.

7. The resistance apparatus of claim 1, further comprising:

at least one pulley mechanism rotatably coupled to an end portion of the outer housing and fixably mated to the axle, wherein when the pulley mechanism is rotated, the pulley mechanism exerts a rotational force on the axle thereby rotating the axle.

8. The resistance apparatus of claim 1, wherein the first tensioned member operates within a force versus displacement curve.

9. An inner housing for use within a resistance apparatus, wherein the inner housing comprising:

an outer portion that is substantially circular;

an inner portion with an opening configured to receive an axle therethrough, wherein at least a portion of the opening is configured for selective engagement by a slidable engagement member of the axle so that the inner portion is engagably mounted on the axle; and at least a first tensioned member disposed within the inner portion, wherein the first tensioned member includes a first end and a second end, and the first end of the tensioned member engages an engagement area on an inner area of the outer portion, the second end of the tensioned member being configured to engage an engagement area of an outer housing that maintains the inner housing, and wherein the tensioned member creates a rotational restoring force between the inner housing and the outer housing.

10. The inner housing of claim 9, wherein the outer portion includes a given number of helical grooves circumscribing the outer portion, wherein the helical grooves are configured to accommodate a cylindrical roller therebetween.

11. The inner housing of claim 10, whereby the given number of helical grooves, in part, are used to pretension the tensioned member, wherein the pretensioned tensioned member exerts restorative a force when at a resting position.

12. A resistance apparatus for use with exercise devices, the resistance apparatus comprising;

an axle;

an outer housing for rotatably mounting the axle therein;

at least one inner housing, with an opening for receiving the axle therethrough, wherein receiving the axle through the opening engagably mounts the inner housing on the axle, whereby the inner housing is rotatably mounted inside the outer housing permitting rotation of the inner housing along with the axle within the outer housing, wherein the axle includes a groove along an axial direction that receives an engagement member slidably mounted within the groove, wherein the engagement member includes a first portion and a second portion, wherein the first portion of the engagement member is configured to mate with a selecting area of the inner housing so as to mechanically couple the axle to the inner housing, wherein the second portion of the engagement member extends beyond the outer housing; and at least a first tensioned member disposed within the inner housing, wherein the first tensioned member includes a first end and a second end, and the first end of the tensioned member engages an engagement area of the inner housing and the second end of the tensioned member engages an engagement area of the outer housing, and wherein the tensioned member creates a rotational restoring force between the inner housing and the outer housing.

13. The resistance apparatus of claim 12, wherein an outer portion of the inner housing includes a given number of helical grooves circumscribing the outer portion.

14. The resistance apparatus of claim 13, wherein the outer housing includes a groove that is disposed within the outer housing parallel to the axle, wherein a void is formed between the helical grooves and the groove disposed on the outer housing to accommodate a cylindrical roller therebetween, and whereby the given number of helical grooves in combination with the groove and the cylindrical roller defines a number of rotations of the inner housing within the outer housing.

15. The resistance apparatus of claim 14, whereby the given number of helical grooves in combination with the groove and the cylindrical roller is used to pretension the tensioned member so that the tensioned member exerts a restorative force when at a resting position.

16. The resistance apparatus of claim 12, wherein the tensioned member is a clock spring with the first end coupled to the engagement area of the inner housing and the second end coupled to the engagement area of the outer housing.

17. The resistance apparatus of claim 12, further comprising:

at least one pulley mechanism rotatably coupled to an end portion of the outer housing and fixably mated to the axle, wherein when the pulley mechanism is rotated, the pulley mechanism exerts a rotational force on the axle thereby rotating the axle.

18. The resistance apparatus of claim 12, wherein the first tensioned member operates within a force versus displacement curve.

* * * * *